United States Patent [19]

Newman et al.

[11] Patent Number: 4,993,313

[45] Date of Patent: Feb. 19, 1991

[54] CONTROL SYSTEM FOR DOORS OF A NEGATIVE AIR PRESSURE ENCLOSURE

[75] Inventors: Eugene E. Newman, Maple Shade; Anthony Natale, Mt. Holly, both of N.J.

[73] Assignee: Gpac, Inc., Pennsauken, N.J.

[21] Appl. No.: 519,216

[22] Filed: May 7, 1990

Related U.S. Application Data

[63] Continuation-in-part of Ser. No. 346,621, May 2, 1989, Pat. No. 4,922,806.

[51] Int. Cl.[5] ..... F24F 11/00

[52] U.S. Cl. ..... 98/1.5; 98/1; 98/33.1; 98/87

[58] Field of Search ..... 98/1, 1.5, 33.1, 87; 49/1, 2; 169/48

[56] References Cited

U.S. PATENT DOCUMENTS

| | | | |
|---|---|---|---|
| H460 | 4/1988 | Werner | 55/385.1 |
| 3,211,075 | 10/1965 | Robson | 98/1.5 |
| 3,916,566 | 11/1975 | Lacombe | 98/33.1 X |
| 3,964,125 | 6/1976 | Tansley | 49/2 X |
| 4,068,568 | 1/1978 | Moss | 98/1.5 X |
| 4,113,175 | 9/1978 | Sutton, Jr. | 98/1.5 X |
| 4,150,606 | 4/1979 | Nelson | 98/115.3 |
| 4,604,111 | 8/1986 | Natale | 98/33.1 X |
| 4,706,551 | 11/1987 | Schofield | 98/33.1 X |

FOREIGN PATENT DOCUMENTS

| | | | |
|---|---|---|---|
| 1143002 | 1/1963 | Fed. Rep. of Germany | 98/1.5 |

*Primary Examiner*—Harold Joyce

*Attorney, Agent, or Firm*—Fleit, Jacobson, Cohn, Price, Holman & Stern

[57] ABSTRACT

An entranceway to an asbestos contaminated work area includes solid doors for a rapid escape from a contaminated work area due to an emergency such as a fire and the dangers posed by exposure to smoke. Also during a power failure it is easy for the workers to leave the work area. The immediate exiting from the work area is thereby greatly facilitated by the solid swinging doors of the invention. Each of the doors have a transparent portion through which the work area or an adjacent chamber of a decontamination chamber may be observed. The doors further include an air inlet having at least one flexible plastic flap covering the inlet which allows suitable amounts of air to flow through the inlet to maintain a negative air pressure in the work area while the air in the work area is changed at least every 10 to 15 minutes. The plastic flaps of the doorway seal automatically upon loss of negative air pressure in the work area.

11 Claims, 4 Drawing Sheets

CONTROL SYSTEM FOR DOORS OF A NEGATIVE AIR PRESSURE ENCLOSURE

This application is a continuation-in-part of U.S. patent application Ser. No. 07/346,621, filed May 2, 1989.

FIELD OF THE INVENTION

This invention relates to doors for a negative air pressure enclosure which prevent the escape of asbestos-containing air from the enclosure to the outside environment, automatically, upon the loss of negative air pressure in the enclosure and allows rapid escape of personnel from the enclosure. In addition, an indication of fire inside or outside of the enclosure is transmitted to a supervised control panel which controls the opening of the doors to the enclosure.

BACKGROUND OF THE INVENTION

In U.S. Pat. No. 4,604,111, a particulate contamination control method and filtration device is disclosed. This patent relates to the serious dangers associated with persons breathing particulate contaminated air. The invention is useful for protecting the outside environment and the individuals working in a highly contaminated area such as occurs when asbestos coatings are removed inside a building structure.

Asbestos fibers fall into the generic classification of hazardous particulate and are a well known carcinogenic hazard to humans and animals. Typical environmental standards refer to fibers that are 5 microns or greater in length with an aspect ratio of 3 to 1 or greater. The average asbestos fiber is about 0.1 micron in diameter. It is now accepted that the thinner fibers are the most dangerous threat to human health. The asbestos fibers, in particular those that are thinner and shorter, remain airborne for considerable lengths of time and contaminate large volumes of air to form a substantial hazard to the environment and to the persons working or living in the area.

U.S. Pat. No. 4,604,111 provides a system and method of containing, lowering, and essentially eliminating the danger of asbestos inhalation by workers in a building in which asbestos fibers are generated at extremely high levels. Asbestos fibers are prevented from being released into the outside environment during an unforseen accident such as a leak through a damaged film barrier and by a flap seal which seals an inlet to a contaminated work area through which workers pass to gain entrance to and exit from the work area.

The flap seal is formed in a plastic wall defining the work area. The "flap seal" includes a two foot by five foot opening about a foot off the floor in a sheet of plastic film, such as polyethylene, plasticized polyvinyl chloride or the like, sealed across an existing door frame of the work area. A polyethylene sheet is sealed across a door frame with an opening cut through the film. The flap is larger in all dimensions than the opening of the same film, is attached to the door frame above the opening and hangs over the full length of the opening such that air and the workers may pass into the work area through the opening, pushing the flap inwardly. However, the configuration is such that once the air flow ceases and positive air pressure develops in the enclosure, the flap falls into place and air is prevented from escaping in the opposite direction to the environment outside of the work room.

In the U.S. Pat. No. 4,604,111, the flap seal is designed to seal the inlet into the contaminated work area. This arrangement has proved very effective in preventing escape of asbestos fibers in the event of loss of negative pressure. However, other factors need to be considered in designing a combined entranceway and exit from a contaminated work area.

In U.S. Pat. No. 4,818,970, a fire condition detection and control system for air moving and filtering units is disclosed. The fire condition detection and control system is for use with air moving and filtering units such as those disclosed in U.S. Pat. No. 4,604,111. The fire condition detection and control system includes one or more remote fire condition detection units, which sense heat or smoke and, upon such sensing, transmit a signal indicative of an alarm condition to one or more air moving and filtering units located within a containment enclosure. The transmission is by wireless radio frequency transmission and/or a wired transmission line or cable. The air moving and filtering unit detects the alarm condition and disconnects power to the blower motor of the air moving and filtering unit. The receiver and control circuitry may be integral with the air moving and filtering unit, or may be part of a separate control unit that plugs into conventional air moving and filtering units.

SUMMARY OF THE INVENTION

By the present invention, an improved entranceway to an asbestos contaminated work area is provided. The solid door of the invention allows a rapid escape from a contaminated work area due to an emergency such as a fire and the dangers posed by exposure to smoke. Also during a power failure it is easy for the workers to leave the work area. The immediate exiting from the work area is thereby greatly facilitated by the solid swinging doors of the invention.

The solid swinging doors of the invention each may have a transparent portion through which the work area or an adjacent chamber of a decontamination chamber may be observed. The doors further include an air inlet having at least one flexible plastic flap covering the inlet which allows suitable amounts of air to flow through the inlet to maintain a negative air pressure in the work area while the air in the work area is changed at least every 10 to 15 minutes. The plastic flaps of the doorway seal automatically upon loss of negative air pressure in the work area.

An object of the present invention is to provide solid swinging doors for the inlet of air into an enclosed work area to maintain a negative air pressure in the work area while allowing a quick exit from the work area in the event of an emergency.

It is another object of the present invention to allow air to pass through a door having an air inlet opening with a flap seal on one side of the doorway so that the air inlet opening is closed upon the loss of negative air pressure in the enclosed work area.

It is still another object of the present invention to provide doors to an enclosed work area which are controlled to swing to a partially open position to allow inlet of air to an enclosed work area to maintain a negative air pressure in the work area and for the doors to close upon the loss of negative air pressure in the work area while allowing a quick exit from the work area in the event of an emergency.

It is yet another object of the present invention to provide a control system for doors of a negative air pressure enclosure which is responsive to a smoke or heat detection signal from at least one fire/smoke sensor located in an least two separate areas inside or outside of the containment enclosure.

It is still yet another object of the present invention to provide a control system for doors of a negative air pressure enclosure which is responsive to a smoke or heat detection signal from at least one fire/smoke sensor located in an least two separate areas inside or outside of the containment enclosure with a supervised control panel with indicators and alarms to regulate the response to detection of smoke or fire by at least one sensor from at least two sensors in at least two separate areas.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
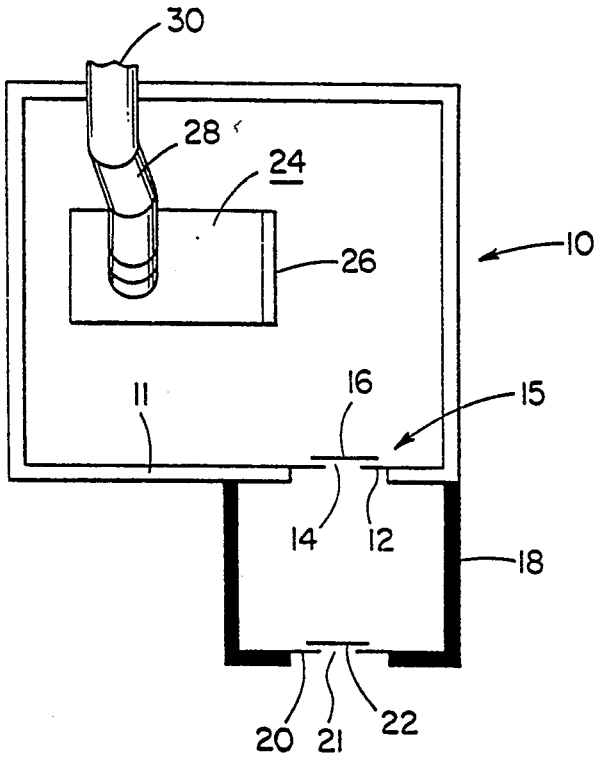
FIG. 1 (PRIOR ART)
FIG. 1 is a floor plan illustrating the use of a prior art entranceway for a particulate contamination control enclosure.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 illustrates the prior practice wherein on the job site, enclosure 10 surrounds an area of high particulate accumulation. This illustrates the embodiment wherein a sealed room is constructed around the area of contamination in its most simple configuration. For the purposes of this figure and of the other floor plan of FIG. 2, the floor and ceiling are in all cases present to complete the enclosure. However, it should be understood that air intakes or inlets, control for air flow, exit ports or outlets and even doorways can be constructed to enter through the roof or through the floor in the same fashion as they are illustrated as passing through the walls in FIGS. 1 and 2. Whenever the term "wall" is used, it is intended to include any of the four vertical walls as well as the ceiling or the floor.

Decontamination chamber 18 is constructed to allow entrance to and exit from enclosure 10 through doorway 15 into the chamber, closed from the outside with flap 22 over opening 21 in film barrier 20. Filtration system 24 is placed in the contamination area in enclosure 10 such that air entering port 26 is filtered and expelled to the environment with 99.99 percent of the particulate contaminants of 0.3 micron size removed through air communication duct 28 to exit vent 30. The filtration system 24 in FIG. 1 is illustrated larger than scale and is preferably placed in a part of the enclosure near the contamination source such that the particulate, such as asbestos coatings, may be removed while maintaining the particulate concentration in the work area at a satisfactory level. This is particularly effective when the source of contamination, typically the work area, is between the persons and the filtration system 24. The substantial air flow being pulled into the filtration means provides a continuous vacuum in enclosure 10 drawing air through the flap seals and maintaining a negative pressure in the room at all times.

Figure 2:
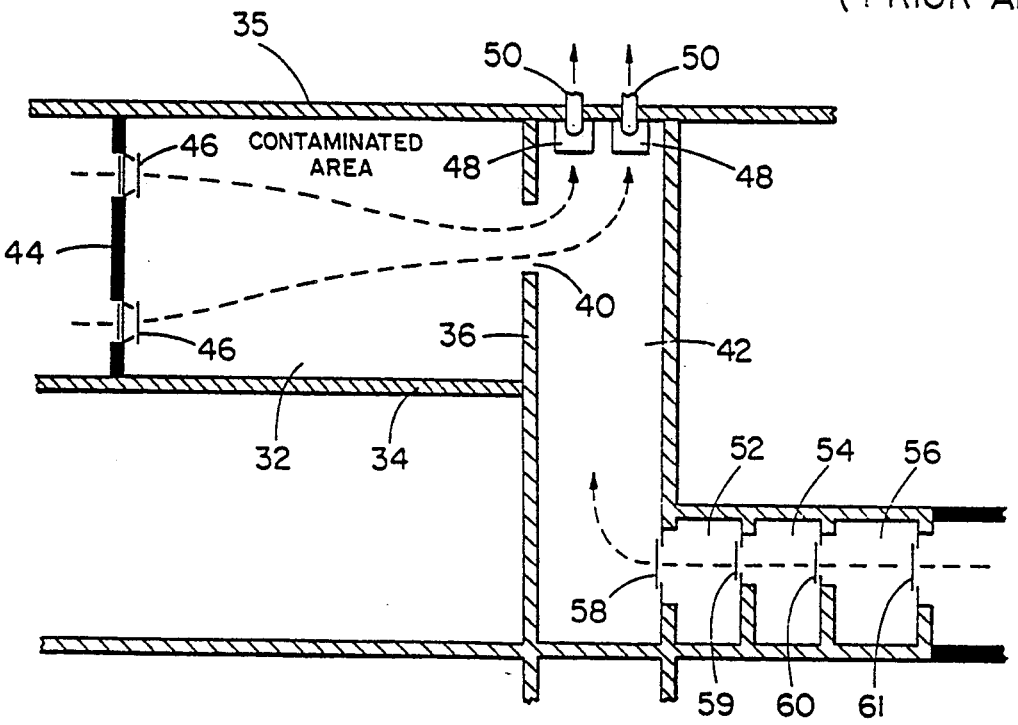
FIG. 2 (PRIOR ART)
FIG. 2 is an additional floor plan illustrating the erection of a decontamination chamber using a prior art entranceway for a particulate contamination control enclosure.

In FIG. 2, a somewhat more complicated configuration is illustrated. In this situation, the contaminated area is in room 32 for which there are three permanent walls 34, 35 and 36 with doorway 40 opening in wall 36 from room 32 to hallway 42. Doorway 40 is maintained in an open condition and any doors are removed or fixed in an open position.

The position of the walls and wall 36 form a barrier to cause the air to flow past the work area and away from the workers who should start at wall 44. Wall 44 is a temporary film wall from floor to ceiling with two flap seals 46 providing for controlled air flow into room 32, past the contaminated area L through doorway 40 and into hallway 42 to a pair of filter systems 48, expelling air through exit ports 50 with the general air flow shown by the dotted lines and arrows. Located on the opposite end of hallway 42 is a decontamination system, including a series of three chambers, dressing room 52, shower room 54 and dressing room 56, containing various decontamination equipment and safety devices including showers, clothing discard systems and vacuum removal, with each successive decontamination chamber being cleaner and cleaner toward the outside environment as each is equipped and separated from the other with flap seals 58 through 61. These flap seals are large enough that a person can enter and leave through the opening by pushing the flap aside. The doorway between hallway 42 and decontamination chamber 52 is equipped with a flap seal 58 as is chamber 56 with flap seal 61, to the outside environment.

Air flow is allowed through the flap seals, through the decontamination chambers, into hallway 42, to be pulled to filter systems 48 to be expelled into the atmosphere after particulate contamination has been removed. In this configuration, in essentially all areas of the decontaminated area, the particulate is being drawn away from the work place, out of the room and away from persons working in room 32.

Figure 3:
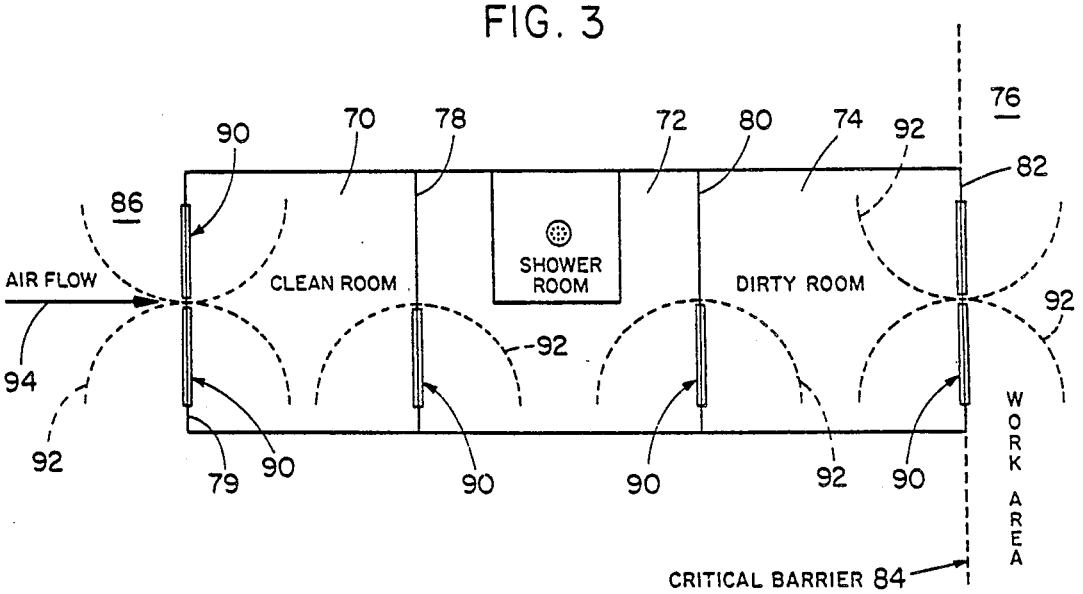
FIG. 3 is a plan view of a decontamination chamber having the solid swinging doors of the present invention.

In FIG. 3, a decontamination chamber similar to that of FIG. 2 is shown in that clean room 70 is separated from shower room 72 and dirty room 74 which leads into work area 76. An enclosed work area as explained with reference to FIGS. 1 and 2 is intended to be shown by work area 76. Solid wall 78 separates clean room 70 and shower room 72 whereas solid wall 80 separates the shower room 72 from dirty room 74. Wall 82 separates the dirty room 74 from work area 76. A critical barrier 84 extends beyond the edges of wall 82 to define the limits of work area 76. The critical barrier may be a solid wall or temporary film wall construction. Walls 78, 80, and 82 may be a pre-existing wall, a wall built for the decontamination chamber or be of temporary film wall construction.

To gain access from the clean area 86 to the clean room 70, from the clean room 70 to the shower room 72, from the shower room 72 to the dirty room 74, and from the dirty room 74 to the work area 76, there exists a series of single or double negative air pressure doors 90. A path of movement of an inner edge of each of the doors 90 is shown by dotted lines 92. An opposite outer edge of the door is pivotably mounted in a respective wall or door frame for free swinging movement of the doors 90 through 180° of movement.

Figure 4:
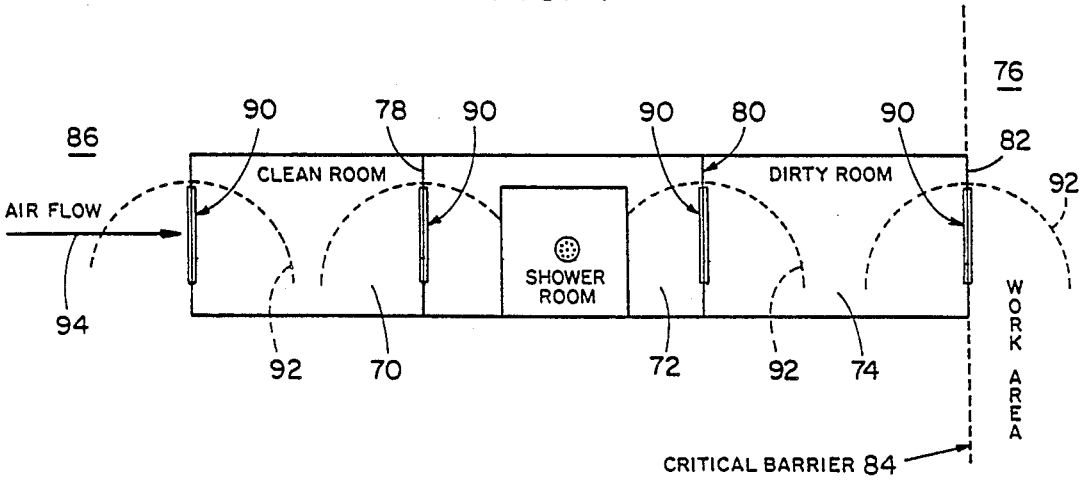
FIG. 4 is a plan view of another decontamination chamber having the solid swinging doors of the invention.

Air flow, as represented by arrow 94, is from the clean area 86 into the clean room 70, into the shower room 72, into the dirty room 74 and into the work area 76. A difference between FIGS. 3 and 4 is that in FIG. 4 all single doors 90 are used whereas in FIG. 3, double doors 90 are mounted in walls 79 and 82. The purpose of the doors and their special functioning is best explained with reference to FIGS. 5 through 8.

Figure 5:
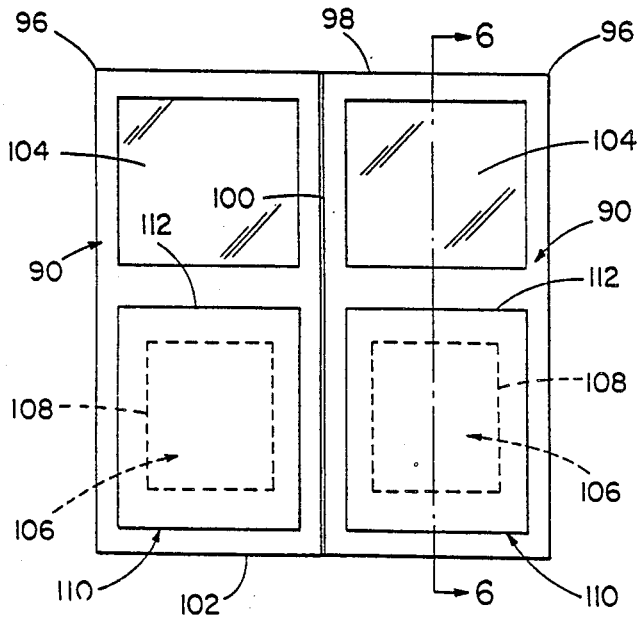
FIG. 5 is a side elevational view of a set of double doors according to the present invention.
Figure 7:
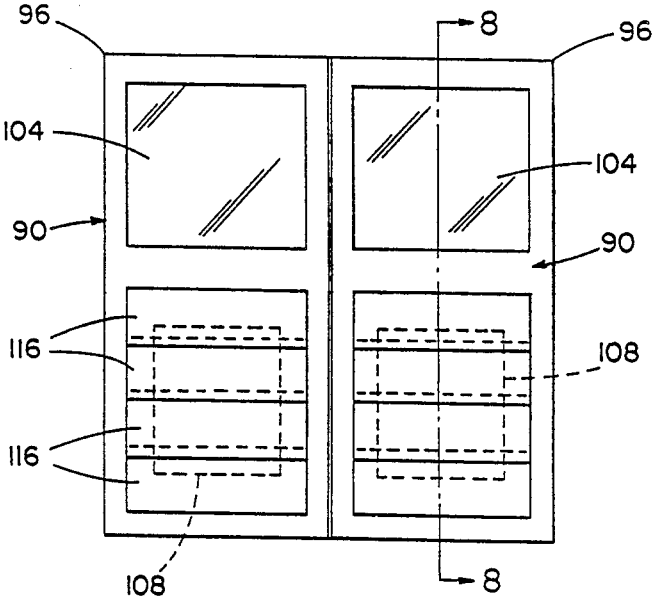
FIG. 7 is a side elevational view of a set of double doors according to an alternative embodiment of the invention.

As shown in FIGS. 5 and 7, double doors 90 are shown as illustrated in FIG. 3 for the entrance to the clean room and for the entrance from the dirty room to the work area. Doors 90 are solid swinging doors capable of 180° movement about pivots or hinges located at the anchored outer edges 96 of the doors and mounted in door frames or walls. At edges 96, and at top edge 98, inner edge 100 and bottom edge 102 are air-sealing gaskets formed of rubber strips which seal the space between the doors and the frames within which the doors are mounted when the doors are in a closed position. The gaskets prevent the movement of air around the doors.

In the closed position, viewing into an adjacent chamber of the decontamination chamber or into the work area or surrounding clean area 86, is facilitated through windows 104 which are preferably made of clear plastic, one-quarter inch thick. In FIGS. 5 and 7, the windows 104 are located in the top portion of the doors; however, it is not necessary that the windows be so located. In the bottom portion of the doors 90 in FIGS. 5 and 7, is defined an air inlet 106 which is formed by peripheral edges 108 shown in dotted lines and in full lines in FIGS. 6 and 8.

In FIG. 5, a flexible plastic flap 110 is mounted at a top edge 112 on a side of the door 90 facing towards the work area 76. By the use of an air moving and filtering device within the work area there is a constant air flow towards the work area as shown by arrow 114 in FIG. 6. The air movement causes the flexible plastic flap 110 to move towards the work area and allow air flow through the air inlet 106. Upon termination of power to the air moving and filtering device, or upon loss of negative air pressure for any reason, the flexible plastic flap will return to a position paralleling the surface of the door 90 so as to seal the air inlet 106 against egress of air from the work area towards the clean area 86. A positive air pressure builds up within the work area 76 and forces the flap 110 against the door and seals the flow of asbestos fiber contaminated air out of the work area.

Figure 6:
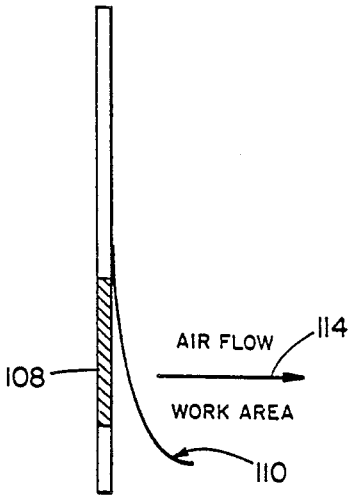
FIG. 6 is a sectional view taken along line 6—6 of FIG. 5.
Figure 8:
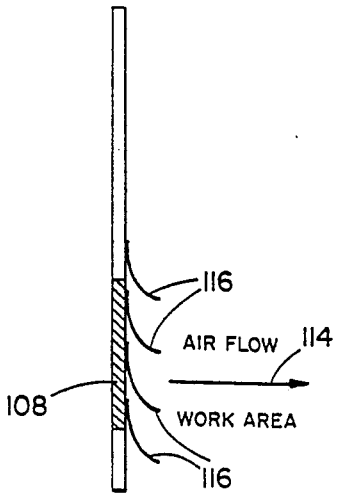
FIG. 8 is a sectional view taken along lines 8—8 of FIG. 7.

Similarly, in FIGS. 7 and 8, a series of partially overlapping flexible plastic flap louvers 116 made of plastic strips are mounted along their top edge to the interior surface of the door, as best shown in FIG. 8 to form a series of flap seals similar to the flap seal formed by flexible plastic flap 110 in FIGS. 5 and 6. The same result is achieved by the flap louvers in FIG. 7 as is accomplished by the single flexible plastic flap 110 in FIG. 5. It is appreciated that the flaps 110 and 116 can be located at the top, the bottom or middle of the door and be of any size to suit the cubic foot per minute requirements for air movement through an air inlet.

In addition, the doors 90 are self-closing by a spring, gravity, weights, eccentric cam, etc. for constant return of the doors to a closed sealing position with their inner edges adjacent each other to allow passage of air from a clean area to a work area through the air inlets, viewing of an adjacent area or room through windows 104 and access for the workers to enter or leave the work area through the doors 90.

During an emergency situation in the work area, the workers may quickly escape from the work area by merely pushing on any portion of the door 90. The doors will rapidly swing open in a direction away from the work area to provide an unhindered path of egress. This design proves much more effective than attempting to pass through a design of overlapping plastic sheets which must be carefully maneuvered to allow passage of personnel.

As an alternative embodiment, the doors 90 may be of solid, imperforate construction and electro-mechanically operated and controlled to open to varying degrees into the work area. The door operation responds to a signal to open the doors to a slight degree as required to maintain a predetermined negative air pressure setting for the work area. The amount of opening of the doors is dependent upon the amount of air needed to flow into the work area in place of the air inlets 108. The doors may automatically close upon receipt of a smoke/fire signal as shown in FIG. 9, an emergency signal, a power failure signal, etc. to prevent escape of contaminated asbestos while allowing the workers to leave the work area quickly.

Similarly, a solid door without an air inlet may be opened by a motor to a controlled amount to regulate the amount of air being drawn into the enclosed work area based upon a measured work area differential pressure. However, the door itself, like the embodiment of the door with flaps over an air inlet, will have its motor deactivated so as to close upon loss of negative air pressure beyond a predetermined differential pressure threshold. In addition, the door will close by deactivation of its opening motor upon receipt of a smoke/fire signal as shown in FIG. 9, emergency signal, loss of power signal or any other contingency which might endanger workers in an enclosed work area due to the high air movement requirements of an asbestos particle contamination control system. The doors are pivotably mounted in a frame so that the personnel trapped within the enclosed work area when the doors automatically move to their closed position may make a quick exit in an emergency and the doors will return to their closed position to prevent further escape of asbestos contaminated air.

Figure 9:
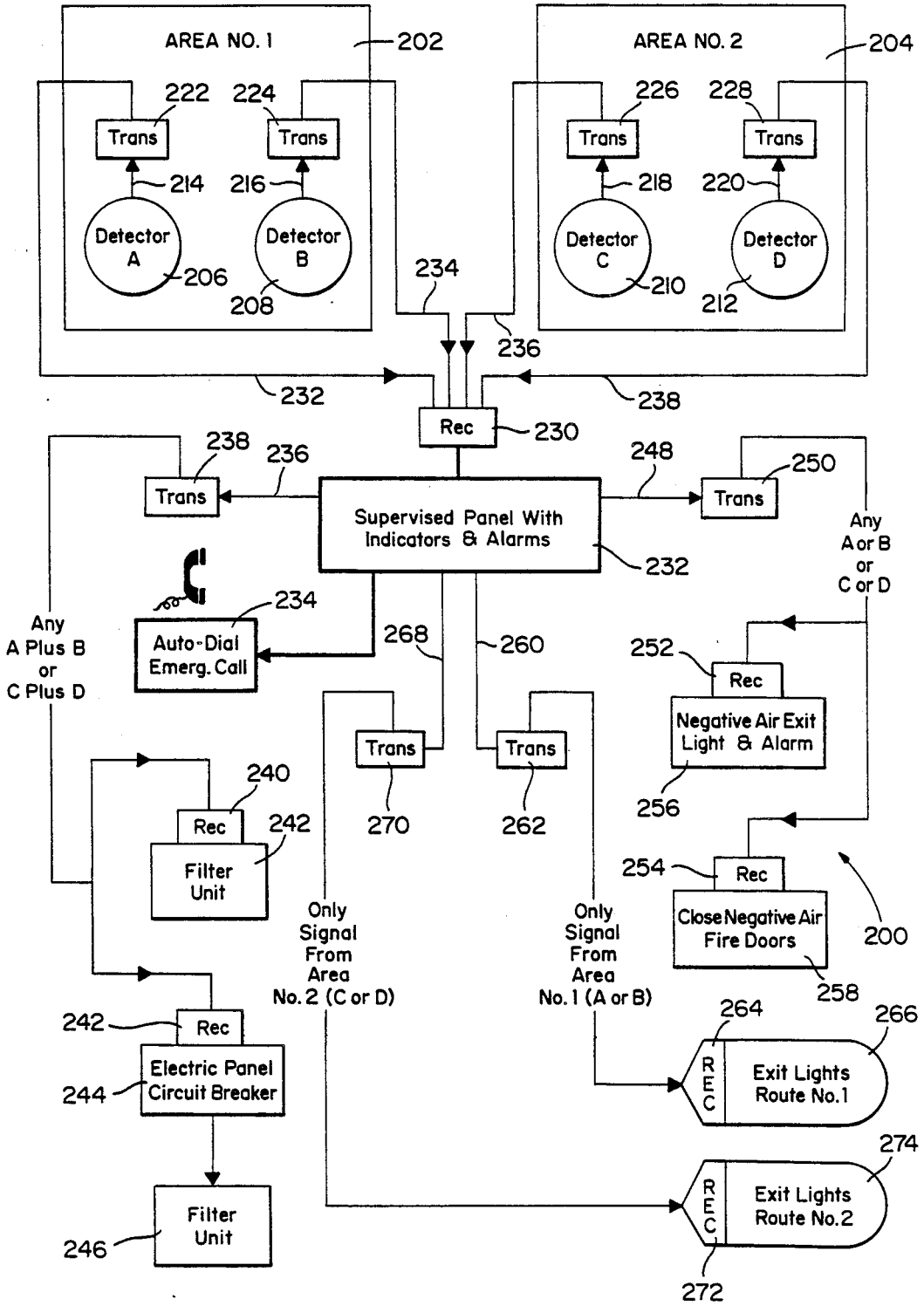
FIG. 9 is a schematic view of a control system for doors of a negative air pressure enclosure.

In FIG. 9, a control system for the doors of a negative air pressure enclosure is generally shown by reference numeral 200. The system is dependent upon a series of smoke/fire detectors as are shown and described in U.S. Pat. No. 4,818,970, incorporated herein by reference.

Two separate areas 202 and 204 labeled as Area No. 1 and Area No. 2, respectively, are representative of (1) an enclosed work area and a work area which is either adjacent to or remote from the work area or (2) are representative of two separate areas which are adjacent to or remote from an enclosed work area. Each area 202, 204 includes at least two smoke/fire sensors 206, 208, and 210, 212, labeled as Detector A and Detector B, and Detector C and Detector D, respectively. It is envisioned that each area 202 and 204 may have many more sensors than the two shown, however, it is required that there be at least two sensors in each area.

The sensors 206, 208, 210, 212 are connected by electrical lines 214, 216, 218, 220, respectively, to transmitters 222, 224, 226, 228 for transmission of a radio frequency (RF) signal to receiver 230. Alternately, the sensors 206, 208, 210, 212 may be hard-wire connected to receiver 230 by cables 232, 234, 236, and 238, respectively.

Receiver 230 is connected to supervised control panel 232 which includes indicators and alarms and which is monitored by trained personnel. A signal is sent from the sensors 206, 208, 210, 212 every sixty minutes or other desired time interval t the control panel 232 for monitoring the operational condition of the sensors.

When any of the sensors 206, 208, 210 or 212 detects the presence of smoke or fire, a signal is transmitted by radio frequency (from transmitter 222, 224, 226 or 228 to receiver 230) or hard-wire to the control panel 232. In the absence of a manual override by the operator of the control panel 232 an autodial emergency call signal is transmitted to automatic dialer 234 to initiate an emergency call to the appropriate authorities as pre-programmed.

In addition, if at least two signals are sent by sensors in Area No. 1 or if at least two signals are sent by sensors in Area No. 2 to the control panel, a signal is generated across line 236 to a transmitter 238 for transmission by radio frequency or alternately, by hard wire to receiver 240 or receiver 242.

Receiver 240 is integral with or connected to a filter unit which draws air into a work area through the doors shown in FIGS. 3 through 8. The individual filtration unit 242 is deactivated by termination of power to its blower motor as is described in U.S. Pat. No. 4,818,970. By this arrangement, each of the individual filtration units 242 includes a separate receiver attuned to the frequency of transmitter 238 or directly connected to control panel 232 by line 236 for halting operation of each filtration unit upon generation of at least two signals from either of the areas 202, 204.

It is understood that there may be many additional separated areas (such as areas 202, 204) with each including at least two fire/smoke sensors. Thus continuance of the operation of the filtration units 242 will only result until detection of fire or smoke by at least two sensors in a single area to prevent shutdown of the filtration units without a confirmation of smoke or fire by more than one sensor in an area.

Alternately, the signal generated across cable 236 may be transmitted by transmitter 238 to receiver 242 or hard wired to receiver 242 which is connected to an electric panel circuit breaker 244. A plurality of filtration units 246 are connected to the electric panel circuit breaker 244 such that upon generation of a signal from the control panel indicative of at least two sensors in a single area detecting smoke or fire, the electric panel circuit breaker 244 is tripped, and in the absence of a manual override at the control panel, shutting off all of the filtration units 246 connected to the electric panel circuit breaker or by prior arrangement, shutting down all of the filtration units 246 except for a predetermined number of filtration units, preferably one, which would remain operative to maintain a slight negative pressure in the work area enclosure to prevent escape of asbestos particles from the work area enclosure. The single filtration unit left on is sufficient to draw air in through air leaks and any holes in the plastic sheeting of the work area but is insufficient to draw open the negative air fire doors.

Separate from a generation of a signal across cable 236 indicative of at least two sensors detecting fire or smoke in a single area, the receipt of a single signal from any one sensor of Area No. 1 or Area No. 2, (202, 204) will generate a signal across cable 248 from control panel 232 to a transmitter 250. The signal transmitted by transmitter 250 is received by receiver 252 and receiver 254 o is alternately hard wired to the receivers 252, 254. Receiver 252 is connected to a negative air exit light and alarm 256 of the work area enclosure. Upon the detection of fire or smoke by any of sensors 206, 208, 210, 212, an emergency system of lighting is activated within the work area enclosure to facilitate the workers finding their way out of the work area enclosure. The light system may be powered by an alternate power source other than the one providing electric current to the work area enclosure due to the possibility of loss of power to the work building. Simultaneously, an alarm is signaled indicative of fire or smoke being detected in either of the separated areas 202 or 204.

Simultaneously, in the embodiment where the solid doors to the work area enclosure are opened to a variable degree by a motor to control the amount of negative air pressure in the work area enclosure, the door drive motor is disconnected by system 258 to allow the negative air doors to be released from their drive and be moved to a closed position to prevent further drawing of air into the work area enclosure. These doors, as described with reference to FIGS. 3 through 8, are double hinged to allow the workers to push open the doors to escape from the work area enclosure. The doors will automatically return to a closed position to prevent further escape of air from the work area enclosure.

Simultaneous with the generation of a signal across cable 248, when a signal is generated by sensors 206 or 208, a signal is generated across cable 260 to transmitter 262 to generate a signal to receiver 264. Upon receipt of a signal by receiver 264, exit lights 266 of a first escape route are lit. Therefore, by the generation of fire or smoke which is detected in area 204, a specific escape route is lit which is provided for escape of the workers in a direction away from area 204. Workers are thereby directed to the best escape route without knowing the actual location of a detected fire or smoke.

Similarly, when fire or smoke is detected by sensor 210 or 212, a signal is generated across cable 268 to transmitter 270 and then to receiver 272 for activation of exits lights 274 along a second escape route. The lighting of the second escape route will provide a path of escape away from the fire or smoke in area 204.

Since all of the signals indicative of the detection of fire or smoke by sensors 206, 208, 210, 212 initially are registered with control panel 232, the operator may manually override any of the functions initiated by the detection of fire or smoke prior to execution of the commands caused as a result of the detection of fire or smoke. It is envisioned that the manually supervised control panel may be replaced by a central processing unit (CPU) which has been programmed to automatically direct the execution of certain commands upon the detection of predetermined conditions. However, this alternative prevents the possibility of manual intervention in the case of a false alarm unless the CPU has been preprogrammed for a test program at a predetermined time.

Having described the invention, many modifications thereto will become apparent to those skilled in the art to which it pertains without deviation from the spirit of the invention as defined by the scope of the appended claims.

We claim:

1. A system for controlling access to and allowing air to flow into a sealed work area which is under negative air pressure and from which asbestos-containing material is removed, said system comprising:

access means for gaining access into the sealed work area, wall means for isolating the sealed work area, said wall means defining at least one opening, said access means including a rigid door pivotably mounted in said at least one opening for entrance and exit of personnel to and from the sealed work area, swinging means for moving said door to provide an air flow path into the work area to maintain a predetermined negative air pressure, at least one sensor means for detecting smoke or fire and for generating a signal upon detection of fire or smoke, control means for receiving a signal from each of said at least one sensor means indicative of the presence of smoke or fire, and means for disabling said swinging means to seal said air flow path by said door upon receipt by said control means of at least one signal from said at least one sensor means.

2. A system according to claim 1, wherein said at least one sensor means is located in the sealed work area.

3. A system according to claim 1, wherein said at least one sensor means is located outside of the sealed work area.

4. A system according to claim 1, wherein said door is pivotable to move in opposite directions of movement from a sealing position of rest.

5. A system according to claim 1, further comprising filtration means for filtering air in the work area, and means for disabling said filtration means upon receipt by said control means of two signals from at least two sensors located spaced from each other.

6. A control system for controlling air flow, said system comprising:

an enclosed work area, a door pivotably mounted in the work area for swinging movement into and out of the work area, at least one filtration unit for filtering air in the work area and for producing a negative air pressure in the work area by drawing air into the work area, moving means for moving the door into the work area according to a predetermined negative air pressure desired for the work area, at least one area having at least two sensor means for detecting smoke or fire and for generating a signal upon detection of fire or smoke, control means for receiving a signal from each of said at least two sensor means indicative of the presence of smoke or fire, means for disabling said swinging means to close the door upon receipt by said control means of one signal from said at least two sensor means, and means for disabling said at least one filtration unit upon receipt by said control means of two signals from said at least two sensor means.

7. A control system as claimed in claim 6, wherein said means for disabling disables all but one of said at least one filtration units when there are at least two filtration units.

8. A control system as claimed in claim 6, wherein said at least one area is located in the work area.

9. A control system as claimed in claim 6, wherein said at least one area is located outside of the work area.

10. A control system as claimed in claim 6, further comprising lighting means for lighting an escape route upon detection of fire or smoke by one of said at least two sensor means, the escape route extending away from the detected fire or smoke.

11. A control system as claimed in claim 6, wherein said at least one area includes two areas each having said at least two sensing means with separate lighting means provided for each of said two areas for lighting an escape route away from an area in which fire or smoke is detected upon detection of fire or smoke by one of said at least two sensors.

* * * * *